US005361821A

United States Patent [19]

Barone

[11] Patent Number: 5,361,821

[45] Date of Patent: Nov. 8, 1994

[54] NO-SEW WINDOW TREATMENT MOUNTING ASSEMBLY

[76] Inventor: Dana Barone, 1155 Walter Blvd., Manahawkin, N.J. 08050

[21] Appl. No.: 116,857

[22] Filed: Sep. 7, 1993

[51] Int. Cl.[5] ..... E06B 9/00

[52] U.S. Cl. ..... 160/39

[58] Field of Search ..... 160/39, 38, 19, 330, 160/327, 354, 368.1, 405, 382, 383

[56] References Cited

U.S. PATENT DOCUMENTS

| | | | |
|---|---|---|---|
| 2,998,062 | 8/1961 | Bixby | 160/39 |
| 4,246,951 | 1/1981 | Givens | 160/39 |
| 5,033,525 | 7/1991 | Paeselt | 160/19 X |
| 5,039,049 | 8/1991 | Niemi | 160/39 X |
| 5,042,549 | 8/1991 | Roberts | 160/39 |
| 5,152,331 | 10/1992 | Barone | 160/19 X |

*Primary Examiner*—David M. Purol
*Attorney, Agent, or Firm*—Charles I. Brodsky

[57] ABSTRACT

The no-sew window treatment of the invention comprises a form of semi-soft foam which is covered by fabric through a wrap and tuck process, along with a mounting assembly for securing the semi-soft foam to a vertical wall surface as a window treatment. The form incorporates a straight slit cut into an exterior surface running along its entire length, and additionally incorporates a cross-shaped slot running through its center, also along its entire length. The fabric employed is wrapped around the form, cut to the length desired, and its ends are then fitted into the straight slit; the sides of the fabric are then tucked into the cross-shaped slot. The mounting assembly for the semi-soft foam incorporates a rod inserted within the slit, but extending outwardly therefrom, to join with an L-bracket for connection to the vertical wall surface. In a preferred embodiment of the invention the rod and the fabric are inserted into the slit by a close-fit force so as to provide support for the form and so as to retain it in position. Either or both of the rod and L-bracket may be adjustable in length so as to afford a degree of versatility in positioning the fabric-wrapped foam.

15 Claims, 2 Drawing Sheets

NO-SEW WINDOW TREATMENT MOUNTING ASSEMBLY

FIELD OF THE INVENTION

This invention relates to styles for decorating or covering windows and, more particularly, to treatment styles for creating valance, cornice and "topper" arrangements simply and inexpensively.

BACKGROUND OF THE INVENTION

As is well known and understood, window treatment stylings and installations are typically handled by a professional designer. The styling and installation required to create a custom valance or cornice is a relatively complex matter, and requires years of experience in order for the treatment to present the look desired. Regardless of the type of design intended, a craftsman having years of experience is usually employed to carry out the decoration or covering desired, and at the high fees and charges which they can typically demand. As will be appreciated, it would obviously be advantageous if a new and unique manufacture were available to make these installations more cost effective, and to provide a "custom look" easily and inexpensively.

Such a new manufacture is described in my U.S. Pat. No. 5,152,331, issued Oct. 6, 1992. There, a no-sew window treatment was described as including a form of semi-soft foam which is covered by fabric through a wrap and tuck process. As explained, the form incorporated a straight slit cut into an exterior surface running along its entire length, and additionally incorporated a cross-shaped slot running through its center, also along its entire length. As set forth, the fabric there employed was wrapped around the form, cut to the length desired, and with its ends fitted into the straight slit. With the sides of the fabric then tucked into the cross-shaped slot, because of the semi-soft characteristics of the foam, and because of the close-fit force which was exerted on the ends and sides of the fabric, the overall result was to provide a form which held the fabric in place—yet, one which was easy to install, cover and assemble (even by the purchaser) and without the need for any sewing to give a customized look.

U.S. Pat. No. 5,152,331 went further in illustrating various shapes and forms that could be utilized in accordance with that invention, showed a manner of joining two typical forms together in developing a window treatment, and illustrated a manner of securing the window treatment in an installation. While the arrangements there described work perfectly well, a need has been found to exist where longer draperies are to be installed, so as to provide added support and so as to insure alignment of the different component foam segments forming the installation. Such provisions will be seen to follow from the following description as regards this invention.

SUMMARY OF THE INVENTION

As will become clear from the description that follows, the window treatment of the present invention operates upon the same "no-sew" forms of my above-identified invention, but incorporates a mounting assembly for the foam, that is inserted within its straight slit, and which extends outwardly thereof to be secured to a vertical wall surface. As will be seen, the mounting assembly includes a longitudinal rod that is inserted within the slit as a close fit, and which is then connected to a vertical wall surface by an L-bracket. In a preferred embodiment, and particularly useful for larger installations, the rod is formed from a pair of longitudinal sections, one of which is slidable within the other along their respective lengths, to be used with L-brackets that may also be adjustable in length. To retain the foam forms on the mounting rod, each longitudinal section will be seen to utilize a first edge inwardly facing of the slit which is at an angular orientation with respect to the plane of that slit into which the section is inserted. Where two such longitudinal sections are employed, such inwardly facing edge of each section are of comparable angular orientation to facilitate the installation. With the semi-soft foam being composed of polyethylene, for example, it becomes a simple matter to then "pop" the foam onto the mounting rod, and move it into position by sliding the longitudinal section(s) within the slit of the foam—where it is then held in place both by the close fit which exists and by the angular orientation of the inwardly facing edge of the section(s) within the slit.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
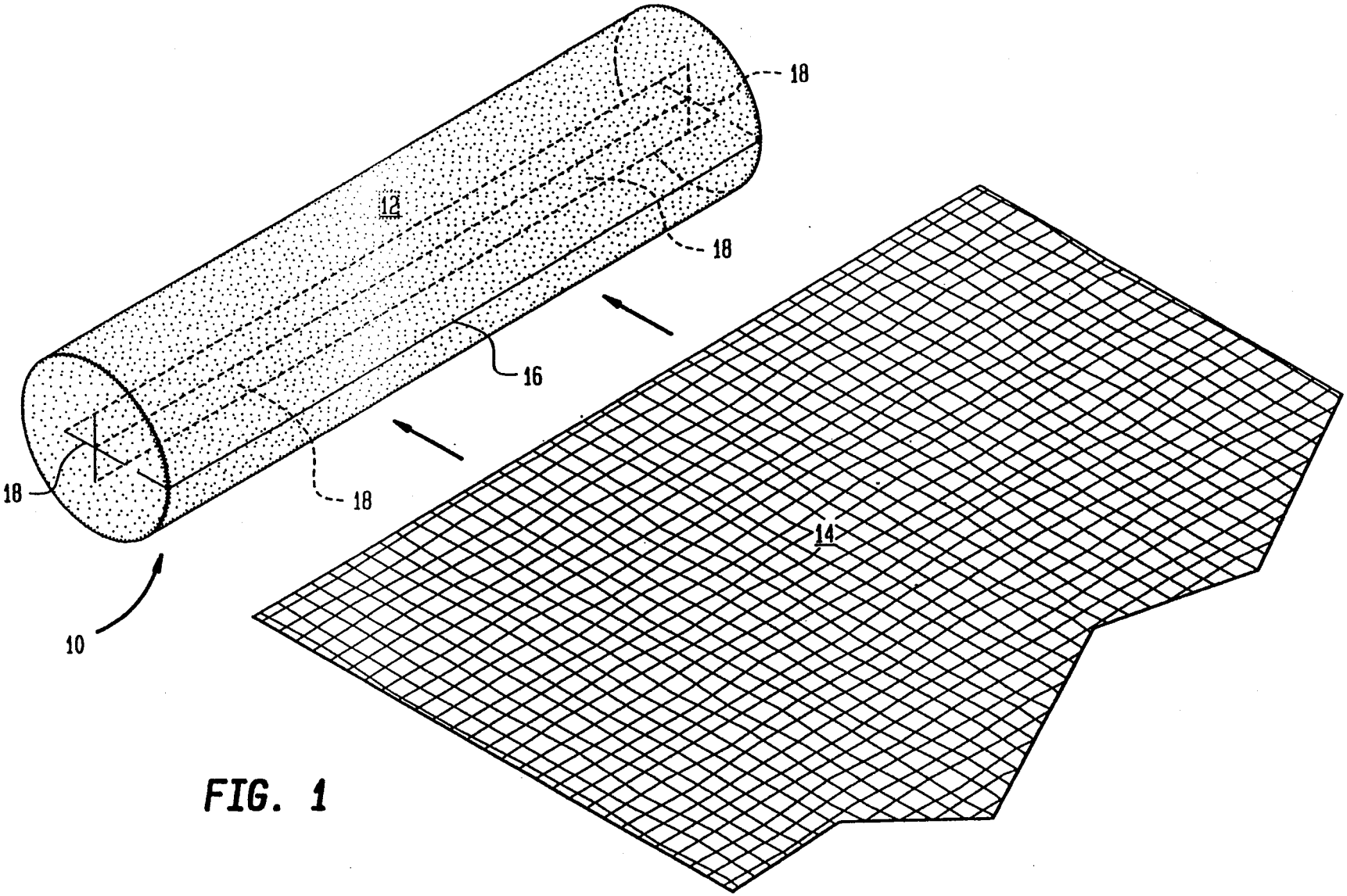
FIG. 1 is a perspective view of semi-soft foam of predetermined shape and dimension, helpful in an understanding of the invention.

Referring now more particularly to FIGS. 1–4, reference numeral 10 identifies a form of semi-soft foam 12 of predetermined shape and dimension, cut to any length desired, either by the purchaser of the foam, or by the designer of the window treatment, or by the manufacturer of pre-arranged treatments. Such form—although shown as being circular—may also be of square, rectangular, or semi-circular cross-section, around which a fabric 14 is to be wrapped and tucked. To facilitate this, a straight-slit 16 is cut into an exterior surface of the foam 12, running along its entire length. Also shown is a slot 18 which additionally runs along the entire length of the foam along its central axis, and of an "X" or cross-shape in a preferred embodiment. As described in my U.S. Pat. No. 5,152,331, the fabric 14 is cut to size, and wrapped around the foam 12 such that its opposite ends are available to be inserted into the straight slit 16, while the opposite sides of the fabric 14 are available to be tucked into the cross-shaped slot 18 running through the foam center. While this can easily be done by hand, the use of a "stake" or similar such tool can be utilized to more easily tuck the sides into the slot 18, and to then rotate the stake in tightening the fabric 14 against the exterior surface of the foam 12. By employing a semi-soft foam—of polyethylene, for example, and of a polyethylene employed in packaging and industrial use, in particular—the fabric 14 is then held in place, flatly secured against the shape of the foam 12, and held there especially when the slit 16 is selected of an opening to accept the opposing ends of the fabric in a close fit. Such polyethylene may have a density of between 1.5 and 4.5 pounds per cubic foot, and able to within a compressive force of between 3 and 19 pounds per square inch. As will be appreciated, such form requires no sewing to hold the fabric in place, and can be cut to measure and can be easily disassembled to change fabric coverings as desired at later times.

(As will be apparent, some window treatment stylings might require the individual forms or shapes to be secured together in creating a multitude of designs—to such end, my aforementioned patent describes the use of variously designed stakes to join one to another in obviously being advantageous in extending the stylings across the window to be covered.)

Figure 2:
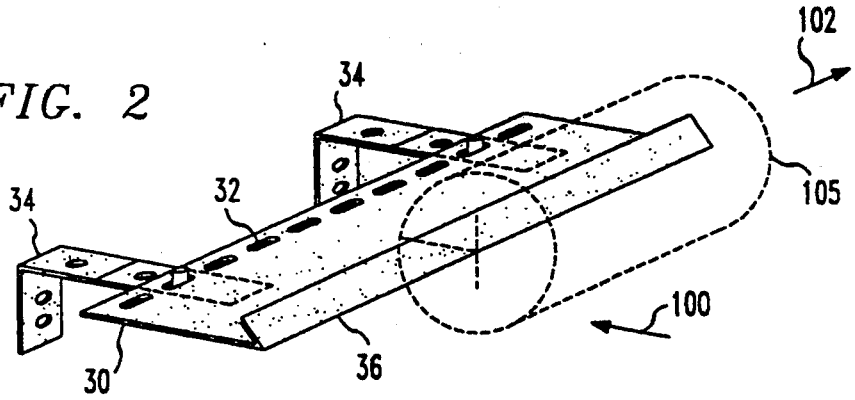
FIG. 2 is helpful in an understanding of one method of mounting the semi-soft foam of FIG. 1 in accordance with the teachings of the invention.

FIG. 2 illustrates a mounting assembly for securing the semi-soft foam of FIG. 1 to a vertical wall surface as a window treatment. As will be seen, the assembly includes a mounting rod 30, generally longitudinal and of planar cross section and with a plurality of holes in linear alignment 32 along the back edge of the rod 30, to receive one or more of a typical L-bracket 34 coupled to the individual holes in securing the rod to the wall surface. The front surface 36 of the rod 30, on the other hand, is shown with an angularly oriented surface which is inserted within the slit 16 of the foam 10, along its length, and in a close-fit. As will be appreciated, the angled surface 36 additionally serves to force the ends of the fabric into the slit 16, to hold them in position, and to serve in restricting the foam from coming off the rod 30. As will be understood by those skilled in the art, the foam 12 is positioned onto the mounting rod 30 by sliding it "on" in the direction indicated by the arrow 100, and by sliding it off by moving it in the direction indicated by the arrow 102. Any type of decorative "button" may be inserted into the slot 18 at the right-end of the foam 12 (as at 105) as a finial in providing an accent, or other finish to the foam once in position.

As will be appreciated, the L-brackets 34 may be adjustable in length, in any conventional manner.

Figure 3:
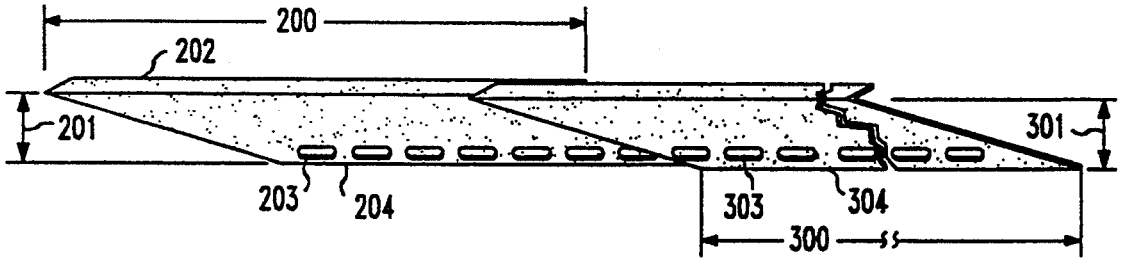
FIG. 3 illustrates a two-section rod for mounting a no-sew semi-soft foam according to the invention.

For larger installations, the mounting rod 30 may be composed of two longitudinal sections, as illustrated in FIG. 3. Three-foot lengths 200, 300 may be selected, and with widths 201, 301 so that one may slide within the other by having comparably angled front edges 202, 302. The linear arrangement of holes 203, 303 on each rod, are arranged to overlap so that the L-brackets employed can connect through aligned holes in securing the mounting rod to the vertical wall surface. Testing has shown that these holes work quite well in an arrangement where they are punched-out 1" on center, where they are of a length $\frac{3}{8}$" (to accept #8 screws), and with a width 201, 301 of some $2\frac{1}{2}$". The holes 203, 303, in one embodiment of the invention, furthermore, were positioned approximately $\frac{1}{8}$" from the rear edge of the sections, 204, 304.

Figure 4:
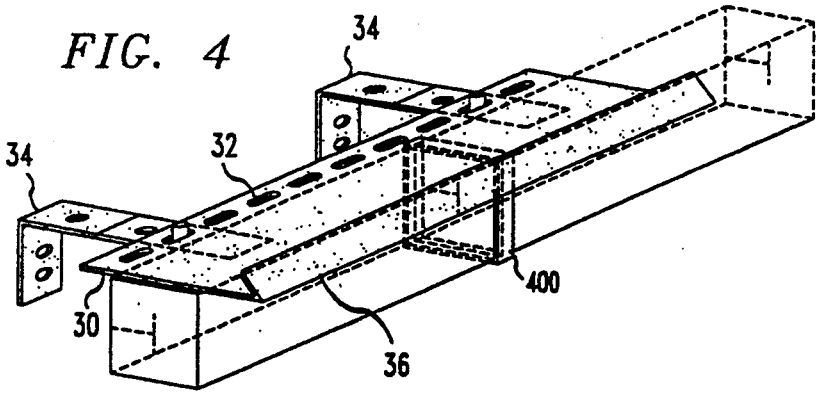
FIG. 4 is helpful in an understanding of mounting a differently configured no-sew semi-soft foam in accordance with the invention.

FIG. 4 shows such sections 200, 300 of the mounting rod as utilized in securing several of the "no-sew" foams to a vertical wall surface as a window treatment. Reference numeral 400 identifies decorative collars to be positioned over any gap that is created where two of the foams adjoin. Such collars 400 may be of a metallized or fabric material, and flexible so that they wrap around the shape employed, with their opposing ends also tucked into the slit 16. Where the collars 400 are of fabric material, they are to be folded or gathered together before being tucked into the slit 16, and of the same design whether the foam shapes be square (as in FIG. 4) or circular, as in FIG. 1 (or otherwise).

Figure 5A:
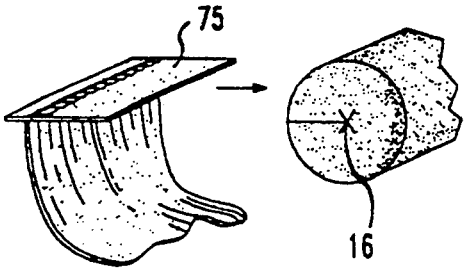
FIG. 5*a*–5*c* illustrates a manner of installing "swags" along with the mounting assembly of the invention.
Figure 5B:
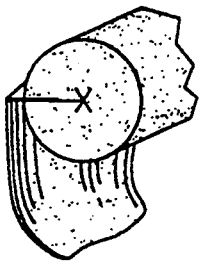
Figure 5C:
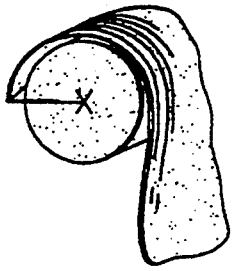

FIGS. 5*a*–5*c* illustrate fabric tabs 75 which can be employed in placing swags along the no-sew window treatment prior to their being installed with the mounting assembly. Shown as being inserted within the slit 16—also in close fit—, the fabric tab 75 may be tucked from underneath the foam 12 (FIG. 5*b*) or tucked from above the foam (FIG. 5*c*). The mounting rod 30 (or the longitudinal sections 200, 300) then also serve to hold the tab 75 in position when inserted within the slit 16 of the foam treatments.

As will be readily appreciated by those skilled in the art, the mounting rods serve to provide increased support to the individual foam treatments—especially when manufactured of a steel composition, as a baked-enamel painted finish on 18 gauge steel of any appropriate color—such as off-white. At the same time, it will be appreciated by those skilled in the art that the use of two or more longitudinal sections (200, 300, etc.) serves to maintain correct alignment of the individual foams, as contrasted with a possible situation in which individual stakes which secure the foams to a vertical structure might be off-center, as is possible according to the teachings in my issued U.S. Pat. No. 5,152,331. With the arrangement herein described, the individual foam sections can simply be slid into position onto the mounting rod, and the L-brackets then inserted through the slot holes to provide the needed support in correct alignment throughout.

While there have been described what are considered to be preferred embodiments of the present invention, it will be readily appreciated by those skilled in the art that modifications can be made without departing from the scope of the teachings herein. Thus, whereas as one construction of the invention utilizes an angular orientation of 45° for the front of the longitudinal sections 202, 302, any appropriate angular orientation may be employed, and of a distance other than a preferred $\frac{1}{4}$" bending as is employed with the embodiment herein described. For at least such reason, therefore, resort should be had to the claims appended hereto for a true understanding of the scope of the invention.

I claim:

1. Apparatus comprising:

an elongated semi-soft foam of predetermined shape and dimension;

a straight slit in an exterior surface of said foam running along the length of said foam;

a slot at least at one end of said foam;

a fabric covering wrapped around said foam, having opposing ends fitted into said slit and opposing sides tucked into said slot; and a mounting assembly for said semi-soft foam, within said slit and extending outwardly thereof, for securing said foam to a vertical wall surface as a window treatment.

2. The apparatus of claim 1 wherein said mounting assembly incorporates a rod inserted within said slit in a close fit.

3. The apparatus of claim 1 wherein said mounting assembly includes a rod inserted within said slit along with the opposing ends of said fabric, both in a close fit.

4. The apparatus of claim 2 wherein said rod is adjustable in length.

5. The apparatus of claim 4 wherein said rod incorporates first and second generally longitudinal sections, one of which is slidable within the other along their respective lengths.

6. The apparatus of claim 2 wherein said rod includes a first edge inwardly facing of said slit and a second edge outwardly facing therefrom, and wherein said first edge is in an angular orientation with respect to the plane of said slit.

7. The apparatus of claim 5 wherein each of said first and second longitudinal sections include a first edge inwardly facing of said slit and a second edge outwardly facing therefrom, and wherein said first edge of each of said sections is in a comparable angular orientation with respect to the plane of said slit.

8. The apparatus of claim 2, also including an L-bracket coupled to said rod for securing said foam to a vertical wall surface.

9. The apparatus of claim 8 wherein said L-bracket is adjustable in length.

10. The apparatus of claim 1 wherein said slot runs along the entire length of said foam.

11. The apparatus of claim 1 wherein said slot is positioned at least at each end of said foam along a central axis thereof.

12. The apparatus of claim 1 wherein the shape of said foam is one of square, rectangular, circular and semi-circular cross-section.

13. The apparatus of claim 1 wherein there is also included:

a second elongated semi-soft foam of predetermined shape and dimension;

a straight-slit in an exterior surface of said second foam running along the length of said second foam;

a slot at least at one end of said second foam;

a fabric covering wrapped around said second foam, having opposing ends fitted into said slit and opposing sides tucked into said slot;

means coupled between said slots on said first and second foams for joining said foams together; and a mounting assembly for said first and second foams, within each of their respective straight-slits as a unitary component, and extending outwardly from each thereof, for securing said first and second foams to a vertical wall surface as a window treatment.

14. The apparatus of claim 13 wherein said mounting assembly incorporates a rod inserted within each slit of said first and second semi-soft foams in a close fit.

15. The apparatus of claim 14, also including an L-bracket connected to said rod for securing said first and second foams to a vertical wall surface.

* * * * *